US005341515A

United States Patent [19]

Cohen

[11] Patent Number: 5,341,515

[45] Date of Patent: Aug. 30, 1994

[54] MEDICAL EXAMINATION GARMENT

[75] Inventor: Robert A. Cohen, Atlanta, Ga.

[73] Assignee: Dignity Wear, Ltd., Boca Raton, Fla.

[21] Appl. No.: 10,329

[22] Filed: Jan. 28, 1993

[51] Int. Cl.[5] ..... A41B 9/00

[52] U.S. Cl. ..... 2/400; 2/406; 2/408; 2/234; 2/78.2; 2/227

[58] Field of Search ..... 2/400, 405, 406, 408, 2/238, 234, 78 R, 78 B, 79, 114, DIG. 6, DIG. 7, 227, 228; 604/385.1, 358, 393, 394, 395, 396; 450/102, 103, 104, 105

[56] References Cited

U.S. PATENT DOCUMENTS

| | | | |
|---|---|---|---|
| 302,901 | 8/1884 | Fenne . | |
| 715,248 | 12/1902 | Davis . | |
| 818,351 | 4/1906 | Clark . | |
| 1,489,046 | 4/1924 | Thompson . | |
| 1,596,681 | 8/1926 | Newman | 2/78 B |
| 1,766,272 | 6/1930 | Vallier . | |
| 1,998,051 | 4/1935 | Gerber . | |
| 2,010,483 | 8/1935 | Goodman | 2/78 B |
| 2,124,366 | 7/1938 | Lasarte . | |
| 2,585,840 | 2/1952 | Reynolds . | |
| 2,661,472 | 12/1953 | Miller . | |
| 2,690,564 | 10/1954 | Kingston et al. . | |
| 3,154,789 | 11/1964 | Lewis . | |
| 3,251,360 | 5/1966 | Melges . | |
| 3,855,635 | 12/1974 | Ramirez . | |
| 4,031,566 | 6/1977 | Johnson . | |
| 4,058,853 | 11/1977 | Boxer et al. . | |
| 4,280,230 | 7/1981 | LaFleur . | |
| 4,382,303 | 5/1983 | Lunt . | |
| 4,389,733 | 6/1983 | Boykin, Jr. | 2/234 |
| 4,446,575 | 5/1984 | Davis | 2/DIG. 7 |
| 4,571,743 | 2/1986 | Wagoner . | |
| 4,608,719 | 9/1986 | Lung . | |
| 4,718,124 | 1/1988 | Sawicki et al. . | |
| 4,759,083 | 7/1988 | Belcher . | |
| 4,771,480 | 9/1988 | Stimson et al. . | |
| 4,807,304 | 2/1989 | McCarts-Reed . | |
| 4,835,795 | 6/1989 | Lonon | 2/408 |
| 4,920,578 | 5/1990 | Janzen et al. . | |
| 4,930,161 | 6/1990 | Cohen | 2/DIG. 7 |
| 4,951,321 | 8/1990 | Mortensen et al. | 2/408 |
| 4,964,173 | 10/1990 | Gordon et al. . | |

FOREIGN PATENT DOCUMENTS

| | | | |
|---|---|---|---|
| 848372 | 10/1939 | France | 2/408 |
| 1474127 | 2/1967 | France . | |
| 7905896 | 8/1978 | Netherlands . | |
| 23779 | of 1894 | United Kingdom . | |

*Primary Examiner*—Clifford D. Crowder
*Assistant Examiner*—Gloria Hale
*Attorney, Agent, or Firm*—Kennedy & Kennedy

[57] ABSTRACT

A medical examination garment (10) has a trunk (11) and a right and left leg (19, 20) extending from the trunk. The trunk, right leg and left leg each have a front portion (17) and a rear portion (18). The garment has an opening (23) therein which extends into the front and rear portions. The garment also has a front flap (24) for covering and uncovering a front portion (25) of the opening, and a rear flap (30) for covering and uncovering a rear portion (31) of the opening. VELCRO strips (28, 29) are provided for securing the front flap to the trunk. Additional VELCRO strip (33,34) are provided for securing the rear flap and rear flaps to each other.

22 Claims, 2 Drawing Sheets

MEDICAL EXAMINATION GARMENT

TECHNICAL FIELD

This invention relates generally to garments for use by medical patients, and specifically to garments for use by patients undergoing proctological, urological or gynecological examinations and treatments.

BACKGROUND OF THE INVENTION

In proctological, urological and gynecological examinations and treatments a doctor's and medical assistant's need for access to a patient's perineum region presents problems for both the patient and the doctor. Typically, the patient disrobes and dons an examination gown. Such a gown provides the doctor with easy access to the patient's perineum region. Though this does reduce the patient's area of exposure, such still exposes more of the patient's body than necessary. Thus, the patient is subjected to undue embarrassment and exposure to the coolness of medical offices and hospitals just at a time when it is important that the patient be relaxed and as comfortable as possible. The anxiety which may result from the patient being uncomfortable may result in complicating the doctor's diagnosis and treatment.

More specifically, in examinations and treatments such as pelvic exams, pap smears, culdoscopy, cryosurgery, dilatation and curettage, leep procedure, in vitro fertilization, tubular occlusion and hysterosalpingograms a female patient typically lies on her back with her legs wide apart and with her feet positioned in stirrups. This positioning of the patient provides the doctor with maximum exposure of the patient's perineum region for examination and treatment.

Heretofore, specialty garments other than the just mentioned medical examination gowns have been devised that are tailored for use by patients undergoing specific medical examinations. Exemplary of such a garment is that shown in U.S. Pat. No. 4,446,575 in which pants for proctological examinations are shown having an elongated, slit-like opening in the rear that extends between the crotch and the waist. An elongated flap is provided for covering the rear opening. The flap is hinged at its lower edge adjacent the crotch. Though such pants are well suited for use with patients while standing, the location of the slit and the flap makes them ill suited for patients lying on their backs.

Another example is shown in U.S. Pat. No. 4,930,161 in which a proctological and gynecological examination pants have a front opening covered by an elongated flap and a rear opening that is covered by a pair of flaps pivoted about folds which are oriented perpendicularly to the top edge of the pants. These pants however do not provide adequate and unobstructed access to the entire perineum area. Furthermore, here again the location of the flaps and the manner in which they are opened makes such pants also ill suited for patients lying on their backs.

Accordingly, it is seen that a need remains for a medical examination garment which provides ready access to the perineum region for proctological, urological or gynecological examinations with a patient lying on his or her back while protecting the patient from undue embarrassment and chill. It is to the provision of such a garment therefore that the present invention is primarily directed.

SUMMARY OF THE INVENTION

In a preferred form of the invention, a garment adapted to be worn by a patient undergoing medical examination or treatment of the perineum, such as a pelvic exam, a urological procedure, in vitro fertilization, tubal occlusion procedure or the like comprises a trunk with front and rear portions that have a waist region, a right leg with front and rear portions extending from the trunk and a left leg with front and rear portions extending from the trunk. An opening, which is spaced from the waist region, has an opening front portion extending into the trunk front portion, the right leg front portion and the left leg front portion. It also has an opening rear portion extending into the trunk rear portion, the right leg rear portion and the left leg rear portion. The garment has a movable front flap mounted to the front portion of the trunk of a size and shape for covering and uncovering the opening front portion, and a movable rear flap mounted to the rear portion of the trunk of a size and shape for covering and uncovering the opening rear portion. With this construction lower abdomen, upper thighs, buttock and genitalia of a patient wearing the garment may remain covered except during actual examination when only the perineum is exposed by moving the front and rear flaps to an uncovering position.

DETAILED DESCRIPTION

Figure 1:
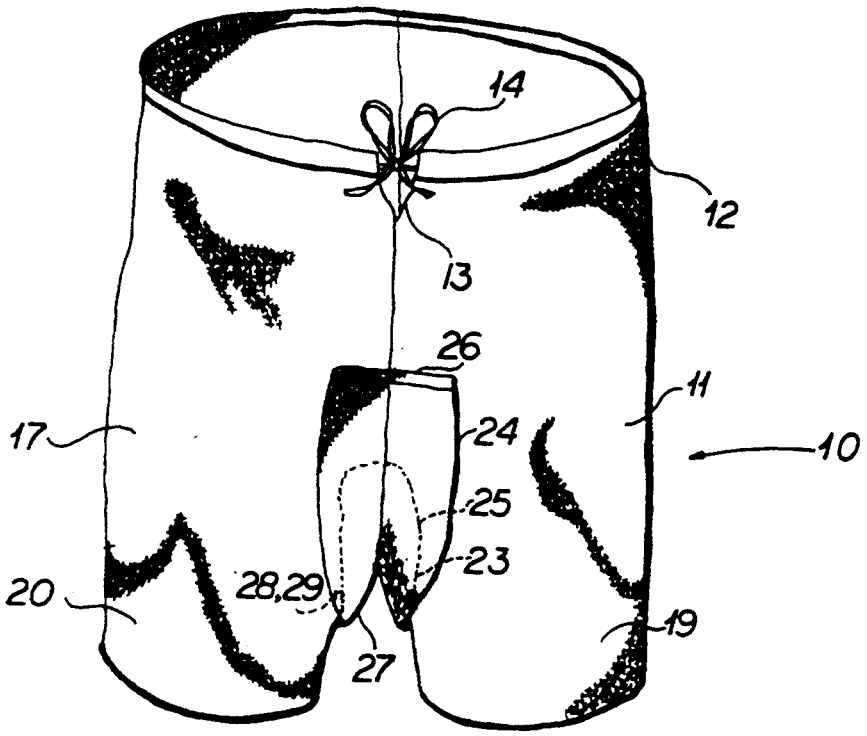
FIG. 1 is a front view of a medical examination garment that embodies principles of the invention in a preferred form.
Figure 2:
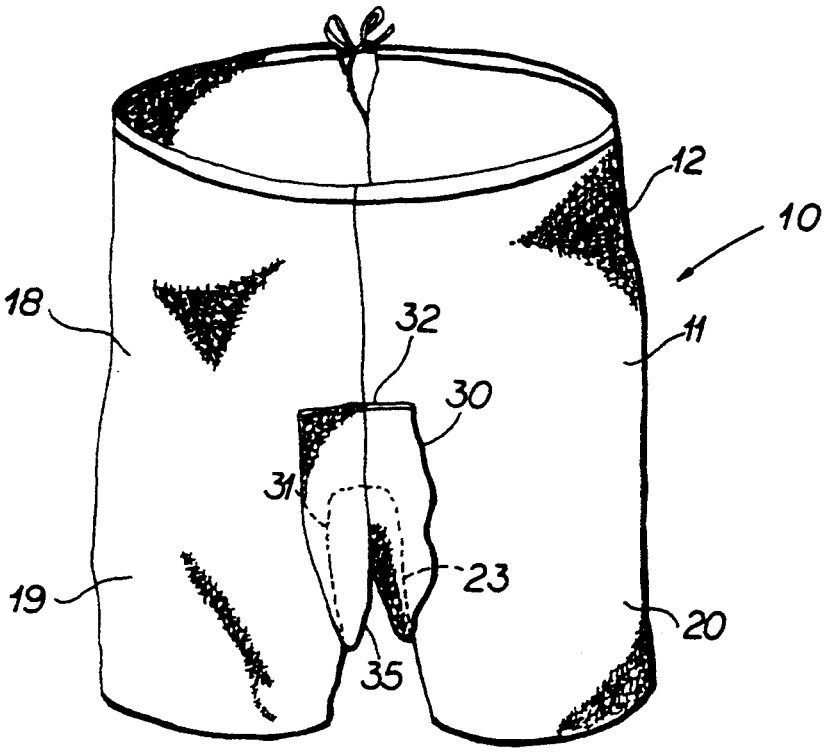
FIG. 2 is a rear view of the medical examination garment of FIG. 1.

With reference next to the drawings, there is shown a medical examination garment 10 having a trunk 11 with a waist region 12 in which a longitudinal slit 13 extends downwardly from the top edge of the garment 10. A tie string 14 is provided for gathering the waist region 12. The garment has a front portion 17 joined along opposite sides to a rear portion 18. A left leg 19 and a right leg 20 extend downwardly from the trunk 11. Except for the tie string, the garment is of unitary construction that may be made of cloth, paper or non-woven fabric.

Figure 3:
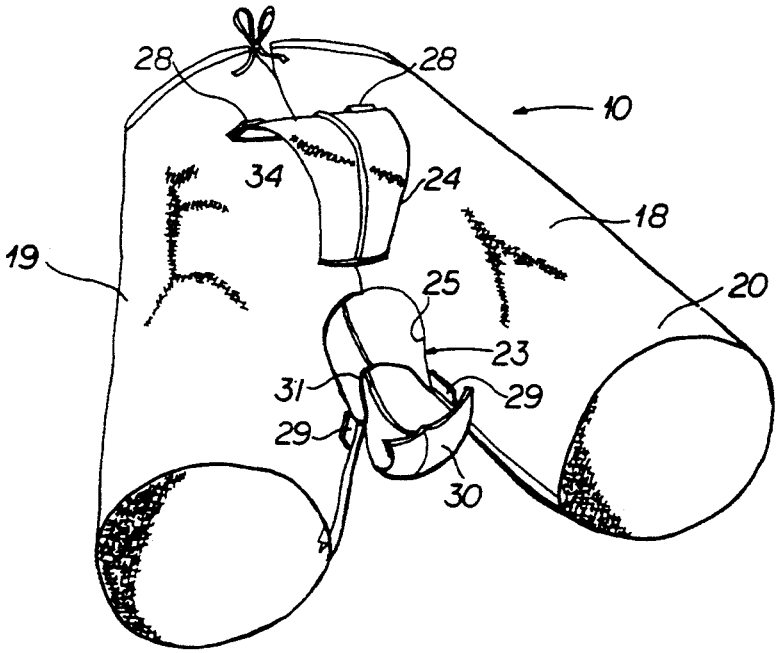
FIG. 3 is a perspective view of the medical examination garment of FIG. 1 shown with its front and rear flaps in an open configuration.

As best shown in FIG. 3, the garment has an opening 23 in the crotch area of the trunk. The opening 23 may be considered as having a front portion 25 in the front portion 17 of the trunk 11, the right leg 20 and the left leg 19, and a rear portion 31 in the rear portion 18 of the trunk 11, the right leg 20 and the left leg 19.

Figure 4:
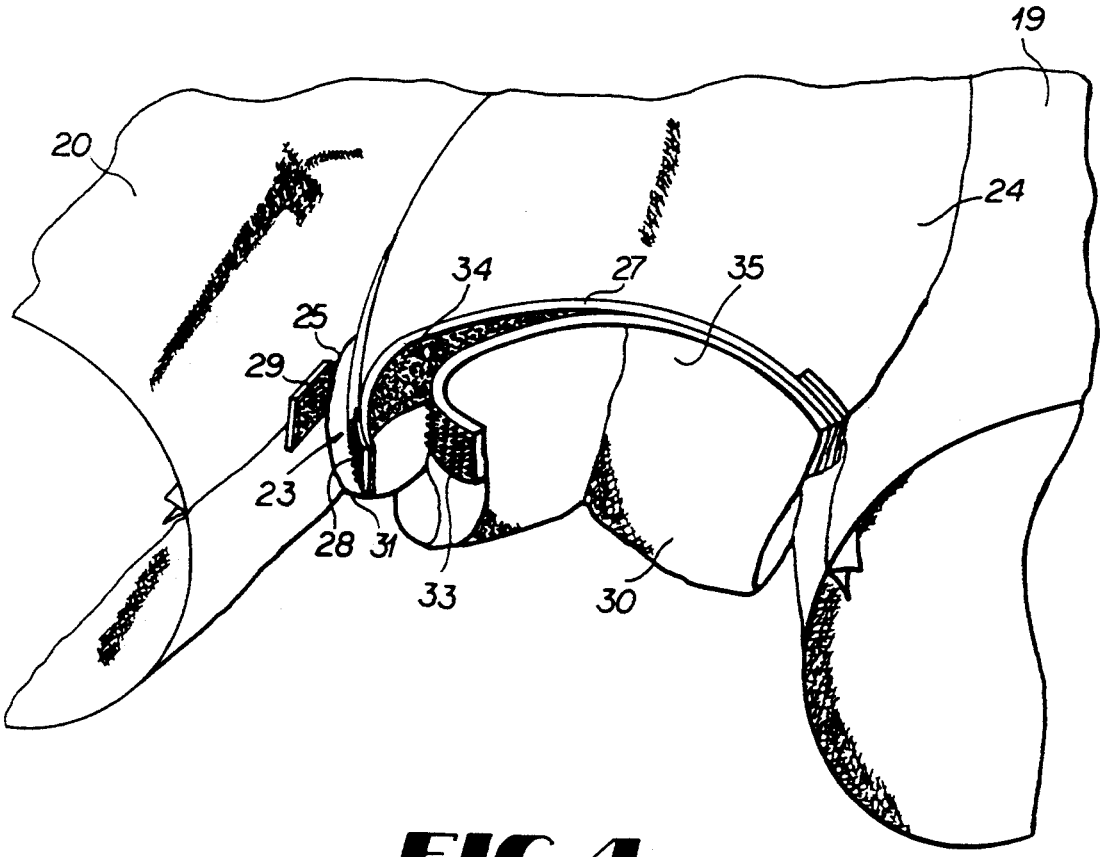
FIG. 4 is a perspective view of the medical examination garment of FIG. 1 shown with its front and rear flaps in a closed configuration.

A front flap 24, which is sized to cover the opening front portion 25, is attached at its top edge 26 to the trunk front portion 17 just above the opening 23. Hook and loop fasteners 28, hereinafter referred to as VELCRO strips, are attached to the underside of the front flap 24 adjacent its bottom edge 27. VELCRO strips 28, adapted to mate with the VELCRO strips 29, are attached to the outside of the trunk adjacent both sides of the opening 23. A rear flap 30, which is sized to cover the opening rear portion 31, is attached at its top edge 32 to the trunk rear portion 18 just above the opening 23. A VELCRO strip 33 is attached to the underside of the rear flap 30 adjacent its bottom edge 35. Another VELCRO strip 34, adapted to mate with the VELCRO strip 33, is attached to the outside of the front flap 24 opposite VELCRO strips 28. With this construction the rear flap 30 may be releasibly fastened to the front flap 24 and thereby cover the entire opening 23 even with the legs 19 and 20 of the garment spread substantially apart, as shown in FIG. 4.

For use, the garment 10 is slipped on over the legs of the patient in the conventional manner as with ordinary pants. This may be facilitated by opening the slit 13 in the front. Once the patient has donned the garment, it is secured by the tie string 14. To remove the garment the tie string is loosened and the garment is slipped off over the patients legs.

To expose the perineum of a patient laying on her back, VELCRO strips 33 and 34 are disengaged from one another to detach the rear flap 30 from the front flap 24. Once detached, the rear flap 30 is folded back as shown in FIG. 3. VELCRO strips 28 and 29 are then disengaged from one another to detach the front flap 24 from the trunk 11. The front flap 24 is then folded back and allowed to rest upon the trunk. The perineum of the patient is now fully exposed and accessible through opening 23.

As previously pointed out, in many proctological and gynecological procedures a female patient is positioned on her back with her legs wide apart. Note that with the patient in this position the flaps 24 and 30 are initially positioned so as to cover the entire opening 23 in order to minimize patient discomfort due to embarrassment or exposure to the coolness of the examination room. However, during actual examination the flaps may easily be moved to a position providing unrestricted access to the patient's entire perineum region while still covering the adjacent portions of the patient body, namely the buttock, lower abdomen and thighs. Upon completion of the examination the physician may reclose the opening 23 before the patient's departure from the examination station. In this manner, the patient's perineum is covered at all times except during the actual examination.

It should be understood that the just described embodiment merely illustrates principles of the invention in its preferred form. Many modifications, additions and deletions may, of course, be made thereto without departure from the spirit and scope of the invention as set forth in the following claims.

I claim:

1. A garment adapted to be worn by a patient undergoing medical examination or treatment of the perineum such as pelvic exams, urological procedures, in vitro fertilization, tubal occlusion procedures and the like, and with the garment comprising:

a trunk with front and rear portions that have a waist region;

a right leg with front and rear portions extending from said trunk which in combination extend circumferentially entirely about a portion of a patient's leg with the garment donned;

a left leg with front and rear portions extending from said trunk which in combination extend circumferentially entirely about a portion of a patient's leg with the garment donned;

said garment having an opening therein spaced from said waist region, said opening having an opening front portion extending into said trunk front portion, said right leg front portion and said left leg front portion, and an opening rear portion extending into said trunk rear portion, said right leg rear portion and said left leg rear portion;

a movable front flap mounted to said trunk front portion having a size and shape for substantially covering and uncovering said opening front portion; and a movable rear flap mounted to said trunk rear portion having a size and shape for substantially covering and uncovering said opening rear portion;

whereby the lower abdomen, upper thighs, buttock and genitalia of a patient wearing the garment remains covered except during actual examination when only the perineum is exposed by moving the front and rear flaps to an uncovering position.

2. The garment of claim 1 wherein said flaps are sized and shaped to overlap each other.

3. The garment of claim 1 further comprising fastening means for releasibly fastening said front flap to said rear flap.

4. A garment adapted to be worn by a patient undergoing medical examination or treatment of the perineum such as pelvic exams, urological procedures, in vitro fertilization, tubal occlusion procedures and the like, and with the garment comprising:

a trunk with front and rear portions that have a waist region;

a right leg extending circumferentially about a portion of a patient's right leg with the garment donned, said right leg having front and rear portions extending from said trunk;

a left leg extending circumferentially about a portion of a patient's left leg with the garment donned, said left leg having front and rear portions extending from said trunk;

said garment having an opening therein spaced from said waist region, said opening having an opening front portion extending into said trunk front portion, said right leg front portion and said left leg front portion, and an opening rear portion extending into said trunk rear portion, said right leg rear portion and said left leg rear portion;

a movable front flap mounted to said trunk front portion having a size and shape for substantially covering and uncovered said opening front portion;

a movable rear flap mounted to said trunk rear portion having a size and shape for substantially covering and uncovering said opening rear portion; and fastening means for releasibly fastening one said flap to at least one said legs in said covering position;

whereby the flaps are readily accessible and movable from a covered position wherein the lower abdomen, upper thighs, buttock and genitalia of a patient wearing the garment are covered to an uncovered position during actual examination wherein only the perineum is exposed through the opening.

5. The garment of claim 4 further comprising fastening means for releasibly fastening the other said flap in said covering position to said one flap.

6. The garment of claim 4 wherein said one flap is said front flap.

7. The garment of claim 6 further comprising fastening means for releasibly fastening said rear flap to said front flap in said covering position.

8. A garment adapted to be worn by a patient undergoing medical examination or treatment of the perineum such as a pelvic exam, urological procedure, in vitro fertilization, tubal occlusion procedure and the like, and with the garment comprising:

a trunk with front and rear portions that have a waist region;

a right leg extending circumferentially about a portion of a patient's right leg with the garment donned, said right leg having front and rear portions extending from said trunk;

a left leg extending circumferentially about a portion of a patient's left leg with the garment donned, said left leg having front and rear portions extending from said trunk;

said trunk, said right leg and said left leg forming a crotch region spaced from said waist region, said crotch region having an opening therein;

a movable front flap mounted to said trunk front portion having a size and shape for substantially covering a front portion of said opening; and a movable rear flap mounted to said trunk rear portion having a size and shape for substantially covering a rear portion of said opening.

9. The garment of claim 8 wherein one said flap is sized and shaped to overlap an end portion of the other said flap.

10. The garment of claim 9 wherein said one flap is said rear flap.

11. The garment of claim 8 further comprising fastening means for releasibly fastening said front flap to said rear flap.

12. The garment of claim 8 further comprising fastening means for releasibly fastening one said flap to said trunk with said one flap covering one said opening portion.

13. The garment of claim 12 wherein said one flap is said front flap.

14. The garment of claim 12 further comprising fastening means for releasibly fastening the other said flap to said one flap.

15. The garment of claim 13 further comprising fastening means for releasibly fastening said rear flap to said front flap.

16. A garment adapted to be worn by a patient undergoing medical examination or treatment of the perineum such as pelvic exams, urological procedures, in vitro fertilization, tubal occlusion procedures and the like, and with the garment comprising:

a trunk with front and rear portions that have an inside and an outside and a waist region;

a right leg extending circumferentially about a patient's right leg, said right leg having front and rear portions extending from said trunk;

a left leg extendable circumferentially about a patient's left leg, said left leg having front and rear portions extending from said trunk;

said garment having an opening therein spaced from said waist region, said opening having an opening front portion extending into said trunk front portion, said right leg front portion and said left leg front portion, and an opening rear portion extending into said trunk rear portion, said right leg rear portion and said left leg rear portion;

a movable front flap mounted to said outside of said trunk front portion having a size and shape for substantially covering and uncovering said opening rear portion; and a movable rear flap mounted to said outside of said trunk rear portion having a size and shape for substantially covering and uncovering said opening rear portion;

whereby the flaps are readily accessible and movable from a covered position wherein the lower abdomen, upper thighs, buttock and genitalia of a patient wearing the garment are covered to an uncovered position during actual examination wherein only the perineum is exposed through the opening.

17. The garment of claim 16 wherein said flaps are sized and shaped to overlap each other.

18. The garment of claim 16 further comprising fastening means for releasibly fastening said front flap to said rear flap.

19. The garment of claim 16 further comprising fastening means for releasibly fastening one said flap to said trunk in said covered position.

20. The garment of claim 19 further comprising fastening means for releasibly fastening the other said flap in said covering position to said one flap.

21. The garment of claim 19 wherein said one flap is said front flap.

22. The garment of claim 21 further comprising fastening means for releasibly fastening said rear flap to said front flap in said covered position.

* * * * *